US009279550B2

(12) United States Patent
Torabifard et al.

(10) Patent No.: US 9,279,550 B2
(45) Date of Patent: Mar. 8, 2016

(54) LUMINAIRES HAVING BATWING PHOTOMETRIC DISTRIBUTION

(71) Applicant: GE Lighting Solutions, LLC, East Cleveland, OH (US)

(72) Inventors: Mozhgan Torabifard, Lachine (CA); Christopher Henry Wilson, Lachine (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 93 days.

(21) Appl. No.: 14/049,550

(22) Filed: Oct. 9, 2013

(65) Prior Publication Data

US 2015/0098215 A1 Apr. 9, 2015

(51) Int. Cl.

| | |
|---|---|
| ***F21V 1/00*** | (2006.01) |
| ***F21V 5/00*** | (2015.01) |
| ***F21V 7/00*** | (2006.01) |
| ***F21K 99/00*** | (2010.01) |
| *F21Y 101/02* | (2006.01) |
| *F21Y 103/00* | (2006.01) |

(52) U.S. Cl.

CPC . *F21K 9/58* (2013.01); *F21V 7/005* (2013.01); *F21V 7/0008* (2013.01); *F21Y 2101/02* (2013.01); *F21Y 2103/003* (2013.01)

(58) Field of Classification Search

CPC ..... F21K 9/58; F21V 7/0008; F21V 7/005; F21Y 2103/003; F21Y 2101/02; F21Y 2103/006

USPC ..... 362/217.07, 217.05, 217.01

See application file for complete search history.

(56) References Cited

U.S. PATENT DOCUMENTS

| | | | | |
|---|---|---|---|---|
| 3,069,769 | A * | 12/1962 | Parks | 72/47 |
| 6,733,154 | B1 | 5/2004 | Dahlen | |
| 2005/0201103 | A1 | 9/2005 | Saccomanno et al. | |
| 2007/0001613 | A1* | 1/2007 | Hulse | 313/634 |
| 2008/0285267 | A1* | 11/2008 | Santoro | 362/224 |
| 2009/0225543 | A1 | 9/2009 | Jacobson et al. | |
| 2010/0277904 | A1* | 11/2010 | Hanley et al. | 362/235 |
| 2011/0141734 | A1 | 6/2011 | Li et al. | |
| 2012/0051041 | A1* | 3/2012 | Edmond et al. | 362/231 |
| 2012/0176792 | A1 | 7/2012 | Stolte et al. | |
| 2012/0299017 | A1* | 11/2012 | Chen | H01L 25/0753 257/88 |

(Continued)

FOREIGN PATENT DOCUMENTS

| | | | |
|---|---|---|---|
| DE | 4024738 | A1 | 2/1992 |
| EP | 1225390 | A1 | 7/2002 |
| WO | 2014011469 | A1 | 1/2014 |

OTHER PUBLICATIONS

International Search Report and Written Opinion issued in connection with corresponding WO Application No. PCT/US2014/059448 dated Dec. 3, 2014.

*Primary Examiner* — Anh Mai
*Assistant Examiner* — Glenn Zimmerman
(74) *Attorney, Agent, or Firm* — GE Global Patent Operation; Peter T. DiMauro

(57) ABSTRACT

An indirect linear luminaire that produces a batwing photometric distribution. The luminaire includes a rectangular housing having a substantially rectangular chamber defined by two opposed bifold wings and a bi-concave door extending therebetween. A linear light engine emits light upwards towards the bi-concave door and bifold wings and the light is reflected off of the bifold wings and bi-concave door in a batwing distribution.

17 Claims, 4 Drawing Sheets

(56) References Cited

U.S. PATENT DOCUMENTS

2013/0194820 A1 8/2013 Pickard et al.
2013/0208495 A1 8/2013 Dau et al.
2014/0009932 A1* 1/2014 Tarsa et al. ..... 362/235
2014/0211484 A1* 7/2014 Howe ..... F21V 13/02 362/326

* cited by examiner

LUMINAIRES HAVING BATWING PHOTOMETRIC DISTRIBUTION

FIELD OF THE INVENTION

The present disclosure relates generally to artificial lighting. More particularly, the present disclosure relates to devices and methods for achieving batwing photometric distributions from light emitting diode (LED) luminaires used in artificial lighting applications.

BACKGROUND OF THE INVENTION

LEDs have become common in many lighting applications. For example, linear LED light engines are employed in luminaires for store display lighting. An issue with such linear LED luminaires is directing the emitted light in such a way to gain the best light distribution for the purpose of illuminating the items being displayed or the store in general.

LED luminaires typically emit light in a diffuse or lambertian light intensity distribution pattern such that the luminance is the same when viewed from any angle. The projection of a lambertian distribution onto a flat surface results in areas of high illuminance directly under the source and areas of lower illuminance away from the source. Thus, luminaires with lambertian distributions are suboptimal in many applications.

A batwing distribution provides increased uniformity when projected onto a plane due to the increased amount of light directed off the primary optical axis. It would be advantageous to have linear LED luminaires that achieve batwing distribution and are useful for lighting store displays.

Controlling the light output and providing batwing distribution is possible by using special refractive lenses for direct lighting systems. This will not work for non-white LEDs however because different colors will appear from the fixture. Another way to control the light distribution is using a metallic reflector, but this creates an image of the light source on the reflector and can cause glare and be objectionable to the customer. The above-described shortcomings significantly limit the usefulness of linear LED luminaires.

SUMMARY OF THE INVENTION

Given the aforementioned deficiencies, it would be advantageous to provide linear LED luminaires that achieve batwing distribution without the use of metallic reflectors or lenses. In at least one aspect, the present disclosure provides an indirect linear luminaire that produces a batwing photometric distribution. The luminaire includes a rectangular housing having a substantially rectangular chamber defined by two white opposed bifold wings and a white bi-concave door extending therebetween. A linear light engine emits light upwards towards the bi-concave door and bifold wings and the light is reflected off of the bifold wings and bi-concave door in a batwing distribution.

The light reflecting from the bi-concave door is emitted most strongly at an angle of about 40 degrees above nadir. The candela intensity of the light at between about 30 and 45 degrees from nadir is from about 1 to 5%, preferably from about 4 to 5% greater than the candela intensity at zero degrees.

The luminaire has the parameters x, y, z, w, and h wherein "x" indicates the half width of the luminaire, "y" indicates the depth of the luminaire, "z" indicates the position of the LED above the bottom plane of the luminaire, "w" indicates the width of the light engine, and "h" is the depth of the biconcave door. To achieve the above mentioned batwing distribution, the depth of the bi-concave door h is between about 0.05y and 0.3y, z is about 0.3y, y is about 0.58x, and w is between about 0.15x and 0.5x.

The narrow batwing light distribution obtained allows for uniform illumination of indoor applications at higher fixture spacings than would be achievable with a purely lambertian distribution.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

Figure 1:
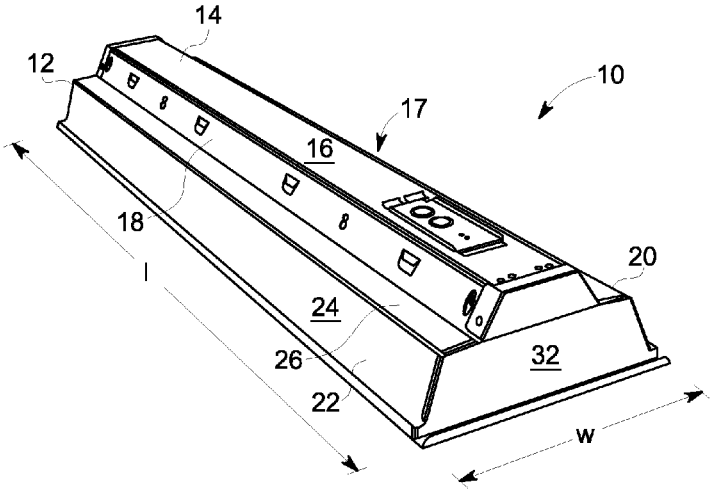
FIG. 1 illustrates a top perspective view of a luminaire in accordance with at least one embodiment of the present disclosure.

The present disclosure may take form in various components and arrangements of components, and in various process operations and arrangements of process operations. The present disclosure is illustrated in the accompanying drawings, throughout which like reference numerals may indicate corresponding or similar parts in the various figures. The drawings are only for purposes of illustrating preferred embodiments and are not to be construed as limiting the disclosure. Given the following enabling description of the drawings, the novel aspects of the present disclosure should become evident to a person of ordinary skill in the art.

DETAILED DESCRIPTION

The following detailed description is merely exemplary in nature and is not intended to limit the applications and uses disclosed herein. Further, there is no intention to be bound by any theory presented in the preceding background or summary or the following detailed description. While embodiments of the present technology are described herein primarily in connection with a particular type of luminaire, especially a 1×4 linear luminaire for a linear light engine, the concepts are also applicable to other types of lighting devices and light engines.

The present disclosure describes an indirect linear luminaire in which the light source is centrally located and upwardly directed with no light emitted directly out of the luminaire from the source. The majority of light is incident on a bi-concave door component and a small amount of light is incident on a housing component; both components are highly reflective with a lambertian character. The light reflecting from the door component is emitted most strongly at an angle of about 40 degrees above nadir (from the bi-concave shape). The housing component emits light in two directions; downward and at a high angle in a lambertian fashion with two maximum light outputs at nadir and 60 degrees. The combination of the three distributions is a narrow batwing distribution with a peak intensity at about 40 degrees from nadir.

FIG. 1 illustrates a top perspective view of a luminaire 10 having a generally rectangular housing 12. Luminaire 10 is shown here having a length "l" of about four feet and a width "w" of about one foot. Housing 12 includes a central ballast channel 14 extending along its length "l" and upper surface. Ballast channel 14 has a back panel 16 and sides 17, 18. Wings 20, 22 further define the housing 12, and are each a bifold having first and second sections 24, 26 respectively, as shown for wing 22 and 28, 30 for wing 20 (shown in FIG. 2). Wings 20 and 22 also include attachment sections 31 and 25, respectively, as shown in FIG. 3. Two end caps (only one 32 is shown in FIG. 1) enclose the housing 12 at each end.

Figure 2:
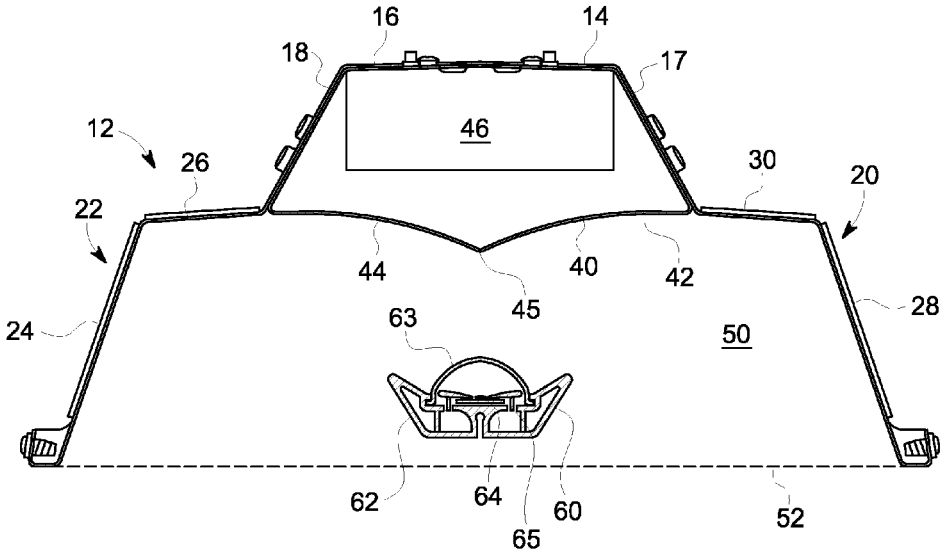
FIG. 2 is a cross sectional view of a luminaire in accordance with the present disclosure that exhibits a batwing luminous intensity distribution.
Figure 3:
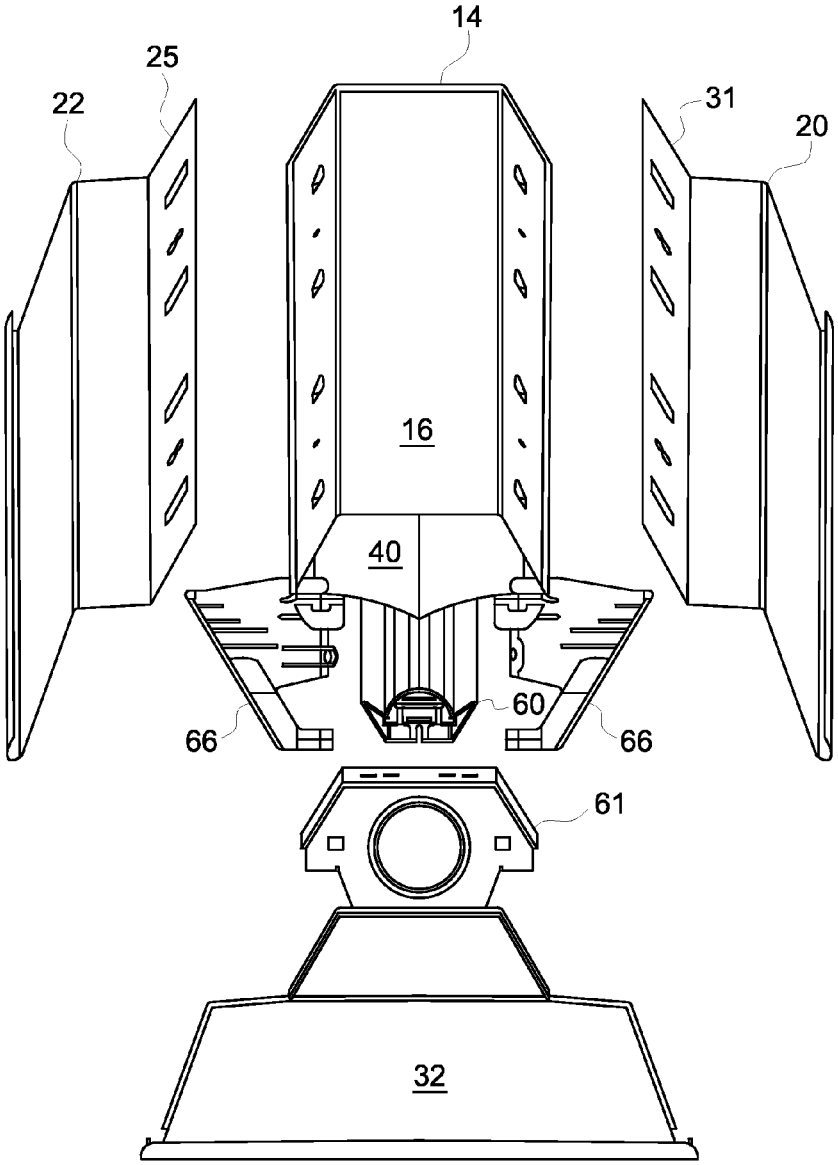
FIG. 3 is an exploded view of the exemplary luminaire illustrated in FIG. 2.

As shown in FIG. 2, ballast channel 14 is closed on its lower surface and within the housing 12 by a bi-concave door 40, having two concave sections 42, 44 that come together at apex 45. Power supply unit 46 is within the ballast channel 14 and mounted to the underside of back panel 16. An open bottomed lower chamber 50 is formed by the wings 20, 22, door 40 and imaginary floor 52.

Linear light engine 60 extends the length "l" of housing 12 and is supported by a bridge on either end (one bridge 61 is shown in FIG. 3). Bridges 61 (the other is not shown) are attached to the undersurface of back panel 16. A pair of bridge covers 64, 66 shield the bridge 61 and associated wires from view and a corresponding pair of bridge covers (not shown) cover the bridge at the other end of the housing 12.

Linear light engine 60 includes heat sink 62 and LED 64. Light engine 60 can include lens 63 and PCB cover 65 as shown in FIG. 2 but these elements are not necessary for the invention.

FIG. 3 is an exploded view of the luminaire 10 illustrating the parts of the luminaire as discussed above.

Figure 4:
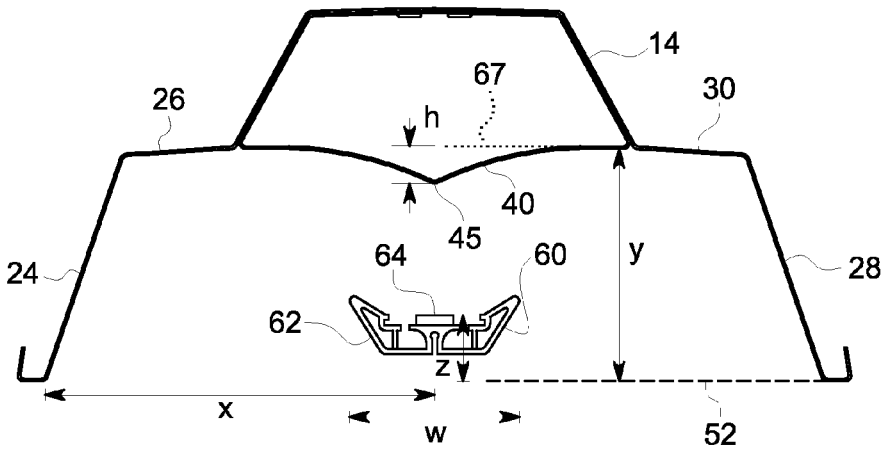
FIG. 4 is a schematic view illustrating the preferred dimensions of a luminaire in accordance with the present disclosure.

FIG. 4 is a schematic view illustrating the dimensions of a preferred embodiment of the luminaire. "x" indicates the half width of the luminaire—the distance between the bottom edge of wing part 24 and the middle of the light engine 60 and directly below apex 45). "y" indicates the depth of the luminaire—the distance between the connection of the ballast channel 14 and the wing part 30 and the imaginary floor 52 of the chamber 50. "z" indicates the position of the LED, the distance between the imaginary floor 52 and the top surface of the LED 64. "w" indicates the width of the light engine 60. "h" is the depth of the biconcave door—the distance between the apex 45 and a line 67 drawn between wing parts 26 and 30.

The batwing light distribution is achieved by providing the luminaire with certain relative dimensions. For a preferred embodiment, the following parameters are appropriate:

$$0.05*y<h<0.3*y;$$

$$z=0.3*y;$$

$$y=0.58*x; \text{ and}$$

$$0.15*x<w<0.5*x.$$

In other words, h is between 0.05y and 0.3y; z is 0.3y; y is 0.58x; and w is between 0.15x and 0.5x.

For a 276 mm wide luminaire, appropriate dimensions for one preferred embodiment are as follows: x=138 mm, y=80.0 mm, z=24.0 mm, w=58.5 mm, and h=13.34 mm. These dimensions will provide a luminaire where the candela intensity gradually increases from zero degrees to the maximum intensity between about 30 and 40 degrees, which is about 4 to 5% greater than the intensity at zero degrees.

The door 40 is modular and can be replaced to alter the photometry of the luminaire and allow for customization by the end user. Changing the height "h" of the door changes the candela intensity differential between the maximum intensity and the intensity at zero degrees. If h is decreased, to closer to 0.05y, the batwing distribution is maintained but the maximum intensity is about 1 to 2% greater than the intensity at zero degrees. A larger h creates a larger differential in the candela intensity.

In use, the LED 64 is centrally located and emits light upwardly in a Lambertian distribution. The luminaire is an indirect luminaire and less than 5% of the light is emitted directly out of the luminaire 10 from the light engine 60. The light from the light engine is incident on the biconcave door 40 and housing wings 20, 22 which are highly reflective with a lambertian character. The light reflecting from the door component is emitted most strongly at an angle of about 40 degrees above nadir (from the bi-concave shape). The housing component emits light in two directions; downward and at a high angle in a lambertian fashion with two maximum light outputs at nadir and 60 degrees. The combination of the three distributions is a narrow batwing distribution with a peak intensity at about 40 degrees from nadir.

Figure 5:
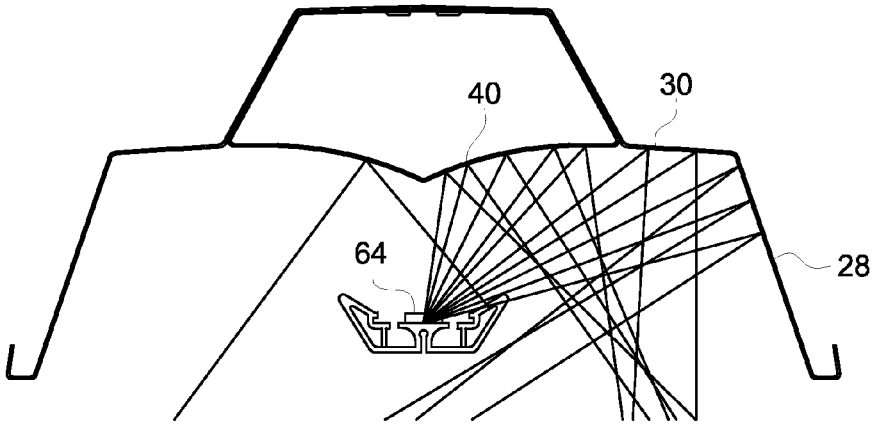
FIG. 5 is a schematic illustration of the light emanating from the light engine and reflected from a luminaire in accordance with the present disclosure.

FIG. 5 partially illustrates the light emanating from the LED 64 and reflected from the door 40 and wing sections 28, 30.

Figure 6:
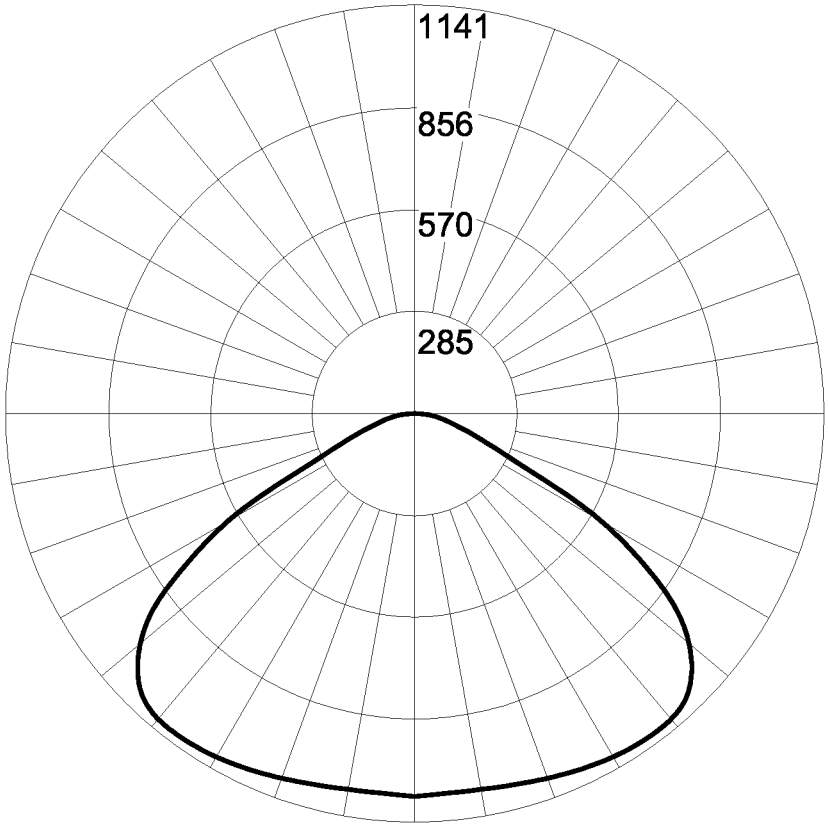
FIG. 6 is an exemplary polar luminous intensity graph showing the batwing photometric distribution of a luminaire in accordance with the present disclosure.

FIG. 6 shows the photometric distribution from the luminaire as a polar luminous intensity graph. FIG. 6 shows the distribution of luminous intensity in candelas in all directions from the center of the light source and illustrates that the distribution has a "batwing" shape. The candela intensity gradually increases from zero degrees to the maximum intensity between about 30 and 40 degrees, which is about from about 1 to 5% greater than the intensity at zero degrees.

The door 40 and wings 20, 22 are desirably made of coated steel although other materials are acceptable, such as coated aluminum. Inside surfaces of the door 40 and wings 20, 22 are white, desirably matte white with a reflectivity higher than 95%. The inside surfaces of door 40 and wings 20, 22 can be painted white or can be a thin film layer.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

We claim:

1. An indirect linear luminaire that produces a batwing photometric distribution; comprising:

a rectangular housing having a substantially rectangular chamber defined by two opposed bifold wings and a bi-concave door extending therebetween; and a linear light engine that emits light upwards towards the bi-concave door and bifold wings;

wherein the light is reflected off of the bifold wings and bi-concave door in a batwing distribution;

and wherein the candela intensity of the light at between about 30 and 40 degrees from nadir is about 1 to 5% greater than the candela intensity at zero degrees.

2. The luminaire of claim 1 having the parameters x, y, z, w, and h wherein "x" indicates the half width of the luminaire, "y" indicates the depth of the luminaire, "z" indicates the position of the LED, "w" indicates the width of the light engine, and "h" is the depth of the bi-concave door; and wherein h is between about 0.05y and 0.3y, z is about 0.3y, y is about 0.58x, and w is between about 0.15x and 0.5x.

3. The luminaire of claim 1 wherein the linear light engine comprises at least one LED.

4. The luminaire of claim 1, wherein the bi-concave door is made of coated steel.

5. The luminaire of claim 1, wherein the bi-concave door is white with a reflectivity higher than 95%.

6. The luminaire of claim 2, wherein when h is 0.3y the candela intensity ratio from the maximum degree to nadir is about 4 to 5% and when h is 0.05y the candela intensity ratio from the maximum degree to nadir is about 1 to 2%.

7. An indirect linear luminaire that produces a batwing photometric distribution, comprising:

a rectangular housing having a substantially rectangular chamber defined by two opposed bifold wings and a bi-concave door extending therebetween; and a linear light engine that emits light upwards towards the bi-concave door and bifold wings;

wherein the bifold wings reflect light downward and at a high angle in a lambertian fashion with two maximum light outputs at nadir and 60 degrees; and wherein the combination of the light reflected from the bi-concave door and the bifold wings has a narrow batwing distribution with a peak intensity at about 40 degrees from nadir.

8. The luminaire of claim 7 wherein the linear light engine comprises at least one LED.

9. The luminaire of claim 7 wherein the bi-concave door comprises two concave sections that connect at an apex.

10. The luminaire of claim 7 wherein less than 5% of the light is emitted directly out of the luminaire from the light engine.

11. The luminaire of claim 7, wherein the bi-concave door and bifold wings are made of coated steel.

12. The luminaire of claim 7, wherein the bi-concave door and bifold wings are white with a reflectivity higher than 95%.

13. An indirect linear luminaire that produces a batwing photometric distribution, comprising:

a rectangular housing having a substantially rectangular chamber defined by two opposed bifold wings and a bi-concave door extending therebetween, wherein the bi-concave door comprises two concave sections that connect at an apex; and a linear light engine that emits light upwards towards the bi-concave door and bifold wings;

wherein the light is reflected off of the bifold wings and bi-concave door in a batwing distribution, and wherein the luminaire has the following parameters:

$0.5*y<h<0.3*y$;

$z=0.3*y$;

$y=0.58*x$; and $0.15*x<w<0.5*x$;

wherein "x" indicates the half width of the luminaire, "y" indicates the depth of the luminaire, "z" indicates the position of the LED, "w" indicates the width of the light engine, and "h" is the depth of the bi-concave door.

14. The luminaire of claim 13, wherein the luminaire has a length of about 1200 mm and the parameters are x=138 mm, y=80.0 mm, z=24.0 mm, w=58.5 mm, and h=13.34 mm.

15. The luminaire of claim 13 where h is between 0.15*y and 0.3*y.

16. The luminaire of claim 15 wherein when h is at its maximum value the candela intensity ratio from the maximum degree to nadir is about 4 to 5% and at the minimum value of h the candela intensity ratio from the maximum degree to nadir is about 1 to 2%.

17. An indirect linear luminaire that produces a batwing photometric distribution having a candela intensity that gradually increases from zero degrees to the maximum intensity between about 30 and 45 degrees, which is about 4 to 5% greater than the intensity at zero degrees.

* * * * *